US008545257B2

(12) United States Patent
Pedruzzi

(10) Patent No.: US 8,545,257 B2
(45) Date of Patent: Oct. 1, 2013

(54) INTEGRATED BANDING CONNECTOR

(76) Inventor: Jason Pedruzzi, Tempe, AZ (US)

( * ) Notice: Subject to any disclaimer, the term of this patent is extended or adjusted under 35 U.S.C. 154(b) by 53 days.

(21) Appl. No.: 13/237,622

(22) Filed: Sep. 20, 2011

(65) Prior Publication Data

US 2013/0072055 A1 Mar. 21, 2013

(51) Int. Cl.
*H01R 13/58* (2006.01)

(52) U.S. Cl.
USPC ..... 439/470; 439/904

(58) Field of Classification Search
USPC ..... 439/470, 465–468, 472
See application file for complete search history.

(56) References Cited

U.S. PATENT DOCUMENTS 4,770,642 A * 9/1988 Van Hoose ..... 439/127
5,139,441 A * 8/1992 Jonval ..... 439/472
5,616,048 A * 4/1997 Myer et al. ..... 439/398
5,839,911 A * 11/1998 Dinkel ..... 439/470
5,908,327 A * 6/1999 Tsuji et al. ..... 439/470
5,967,830 A * 10/1999 Tsuji ..... 439/470
6,019,638 A * 2/2000 Saka et al. ..... 439/620.15
6,196,865 B1 * 3/2001 Ruffel et al. ..... 439/472
6,955,558 B1 * 10/2005 Low et al. ..... 439/467
7,021,959 B2 * 4/2006 Tsuji et al. ..... 439/470
7,201,592 B2 * 4/2007 Hata ..... 439/206
7,252,536 B2 * 8/2007 Lazaro et al. ..... 439/470
7,419,402 B2 * 9/2008 Carnahan et al. ..... 439/470
7,422,470 B2 * 9/2008 Tsuji ..... 439/470
7,641,504 B1 1/2010 Padruzzi

* cited by examiner

*Primary Examiner* — Amy Cohen Johnson
*Assistant Examiner* — Vladimir Imas
(74) *Attorney, Agent, or Firm* — Hovey Williams LLP

(57) ABSTRACT

Integrated electrical connectors (14) and electrical cable assemblies (10) constructed therewith are provided. Connectors (14) permit termination of braided electrical cables (12) without the use of backshell adapters and without requiring undue stretching of the braided sheath (84) over a relatively large cable sheath termination nipple (46) which could lead to undesirable EMI. Connectors (14) comprise a plurality of hinged petals (40) that are shiftable between an open position, which permits access to the connector insert (18) carried by the connector (14) and a closed position in which the petals (40) cooperate to define an appropriately-sized cable sheath termination nipple (46).

24 Claims, 5 Drawing Sheets

INTEGRATED BANDING CONNECTOR

BACKGROUND OF THE INVENTION

1. Field of the Invention

The present invention is directed toward an integrated electrical connector for terminating an electrical cable and electrical cable assemblies constructed therewith. Particularly, the electrical connector is configured so as to be used without a backshell adapter. In order to accomplish this function, the connector includes a plurality of hinged petals having structures that when drawn toward each other define a cable sheath termination nipple. The petals open up to provide access to the connector insert for facilitating termination of wires carried by the cable. The present electrical connector permits use of relatively small diameter cables with integrated electrical connectors thereby eliminating the need for a backshell adapter.

2. Description of the Prior Art

Electrical connectors of varying configurations are used to terminate an electrical cable so as to permit interfacing between the wires of the cable and another electronic device. Certain electrical connectors comprise plug connectors, which present pins or other similar "male" structure, and other electrical connectors comprise receptacle connectors, which present one or more "female" structures into which corresponding pins can be inserted. Wires carried by an electrical cable are inserted into the connector and coupled with a connector insert that carries the pins or receptacles as the case may be.

In order to insert the wires into the connector and then the connector insert, the opening at the cable-receiving end of the connector must be at least as large as the connector insert itself so as to facilitate access to all receptacles of the connector insert. However, in certain applications, the electrical connector has the capability of accommodating more wires than the electrical cable to be coupled therewith carries. This presents a problem, particularly when trying to directly secure a cable having an outer braided sheath to the connector.

The braided sheath shields and protects the wiring from the effects of electromagnetic interference (EMI). EMI is a disturbance that affects an electrical circuit due to either electromagnetic induction or electromagnetic radiation emitted from an external source. The disturbance may interrupt, obstruct, or otherwise degrade or limit the performance of the circuit. The braided sheath operates to limit the effects of EMI on the signals being carried by the cable's wires.

If a smaller diameter cable having a braided sheath is to be coupled with an electrical connector having the capability of handling more wires than carried by the cable, the braided sheath would need to be stretched over a sheath termination nipple forming a part of the connector. This stretching operation may open up windows in the braiding which could lead to undesirable EMI. In order to avoid this problem, electrical connector backshell adapters have been used to anchor the electrical cable and sheath. As the backshell adapter does not terminate the wires carried by the cable, access to the interior of the backshell adapter is less of an issue and a smaller diameter sheath termination nipple may be used compared to the sheath termination nipple on an integrated electrical connector. The backshell adapter is then coupled with an appropriately dimensioned electrical connector that does not include any mounting structure for the cable or sheath.

The use of separate connectors and backshells for terminating an electrical cable has been a traditional solution to the aforementioned problem. However, drawbacks to this approach are apparent in that two separate pieces of equipment are required which increases the expense and labor involved in terminating the cable. Therefore, there is a need in the art for a single piece, integrated connector that is capable of terminating an electrical cable bearing fewer wires than the connector itself is designed to accommodate, while avoiding over-stretching of the braided sheath that could lead to degradation or interference with the signals carried by the cable's wires.

SUMMARY OF THE INVENTION

The present invention overcomes the aforementioned problems by providing, according to one embodiment, an electrical connector comprising a connector housing having a first port and a second port, a connector insert located within the housing, and a plurality of hinged petals secured to the housing. The connector insert is configured to receive one or more wires that are introduced into the connector housing through the first port. The plurality of hinged petals are secured to the connector housing adjacent the first port and are shiftable between a closed position at least partially covering the first port and an open position exposing the first port. Shifting of the petals to the open position provides substantially unobstructed access to the connector insert located within the housing. The petals, when in the closed position, cooperate to define a cable sheath termination nipple providing structure for coupling of the connector with an electrical cable. The cable sheath termination nipple has a central through opening with a diameter that is less than the diameter of the connector insert.

According to another embodiment of the present invention, there is provided an electrical connector comprising a connector housing, a connector insert located within the housing, and a plurality of hinged petals. The connector housing comprises a first port and a second port, with the plurality of petals being secured to the housing adjacent the first port. The connector insert is configured to receive one or more wires that have been inserted into the connector through the first port. The plurality of hinged petals are shiftable between a closed position at least partially covering the first port and an open position exposing the first port. Each of the hinged petals comprises a substantially planar section configured to cover at least a portion of the first port when in the petal is in the closed position and a nipple segment extending transversely from the planar section. The nipple segments cooperate to define a cable sheath termination nipple.

In still other embodiments according to the present invention, there is provided an electrical cable assembly comprising an electrical cable carrying one or more wires and an electrical connector, such as described herein, secured to an end of the electrical cable.

DETAILED DESCRIPTION OF THE PREFERRED EMBODIMENT

Figure 1:
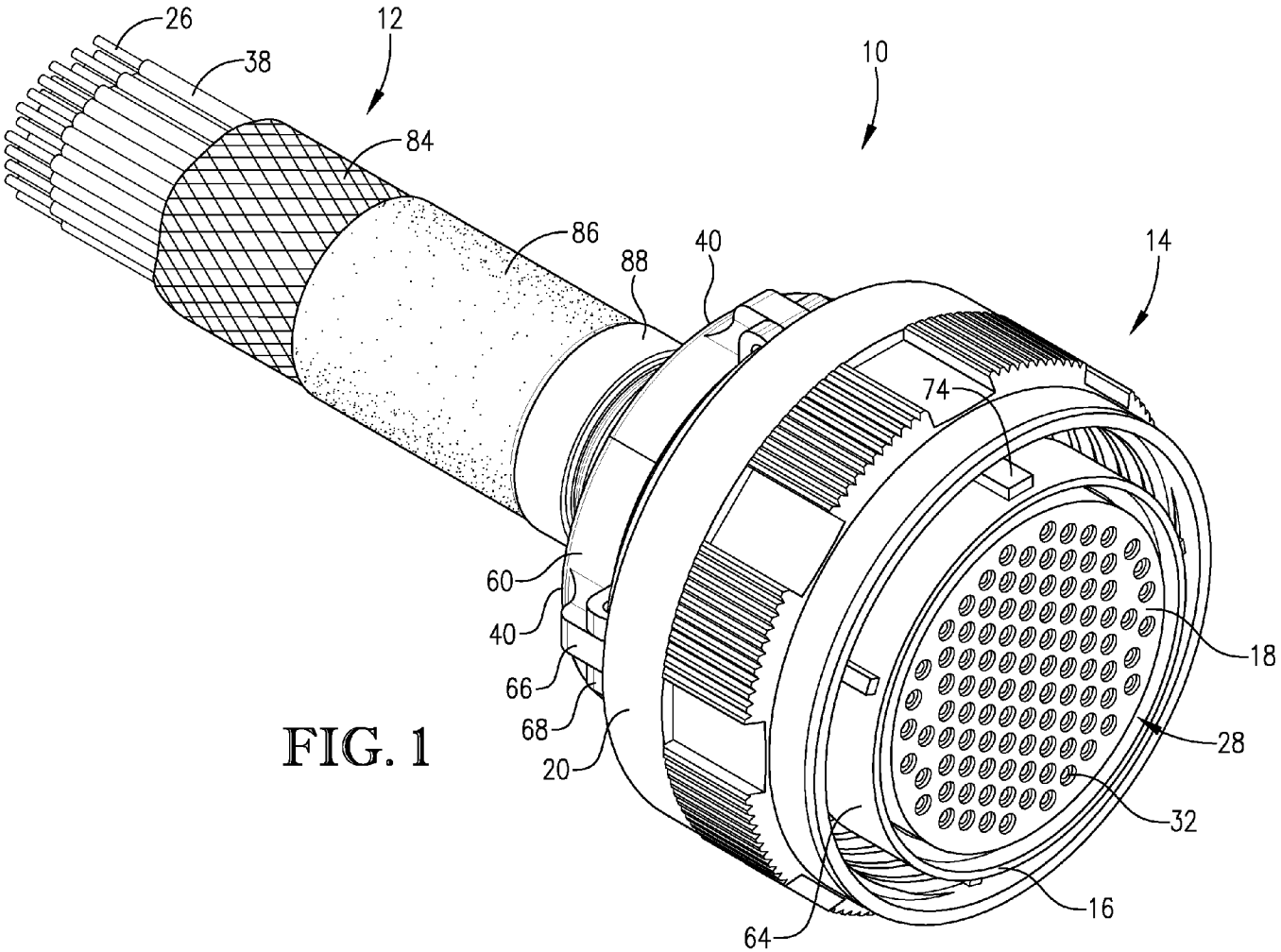
FIG. 1 is a perspective view of an electrical connector assembly in accordance with one embodiment of the present invention.
Figure 2:
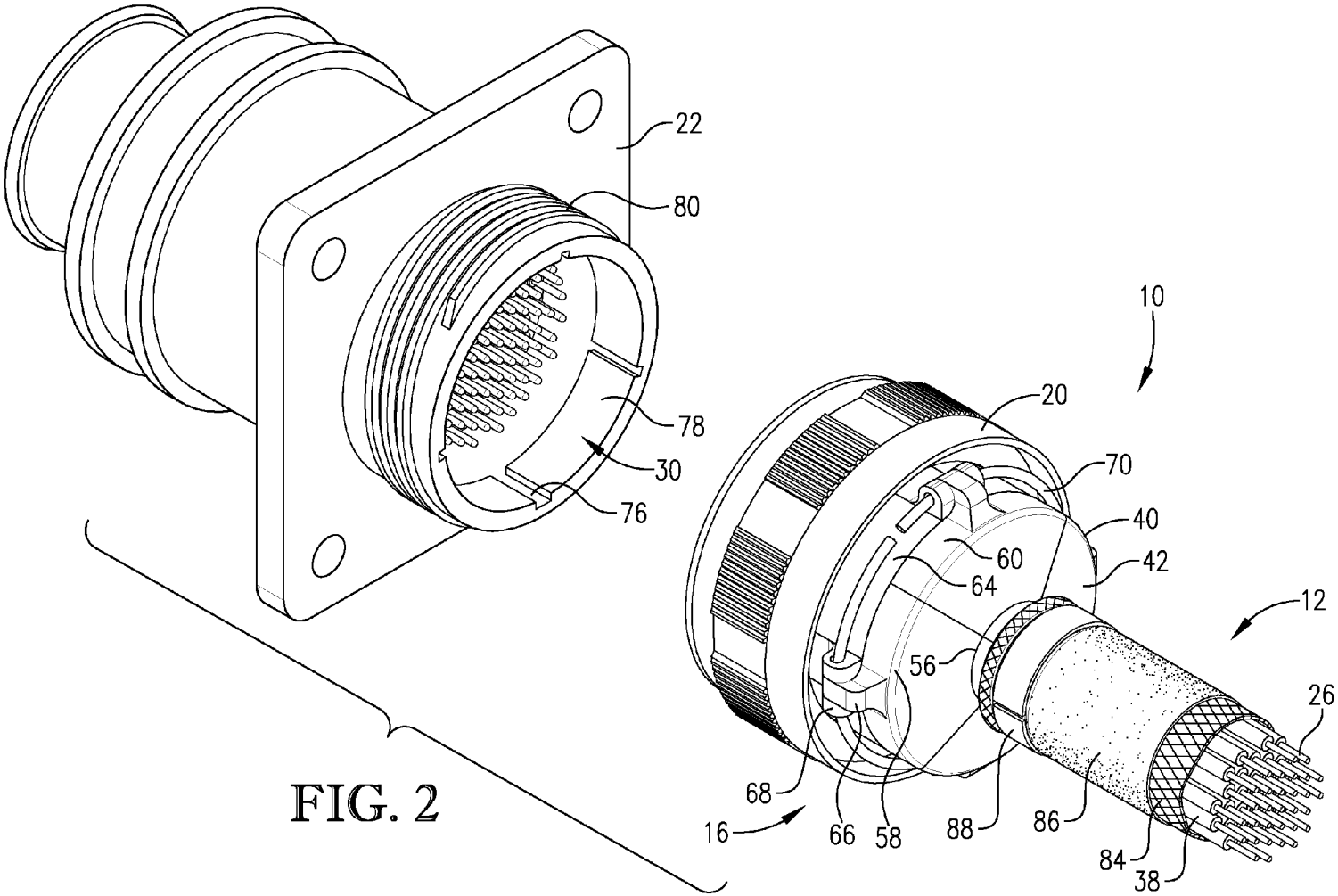
FIG. 2 is a perspective view of the electrical connector assembly of FIG. 1 and an exemplary plug connector to which it may be mated.

Turning now to FIG. 1, an electrical cable assembly 10 is shown comprising an electric cable 12 and an electrical connector 14 made in accordance with one embodiment of the present invention. Connector 14 comprises a connector housing 16 and a connector insert 18 disposed therein. In certain embodiments, housing 16 is made from a radiopaque material, such as metal, and insert 18 comprises primarily a non-conductive material such as a synthetic resin material (i.e., plastic) or ceramic. Connector 14 also includes a threaded outer nut 20 that can be used to fasten connector 14 to a companion connector 22 (as shown in FIG. 2).

Figure 3:
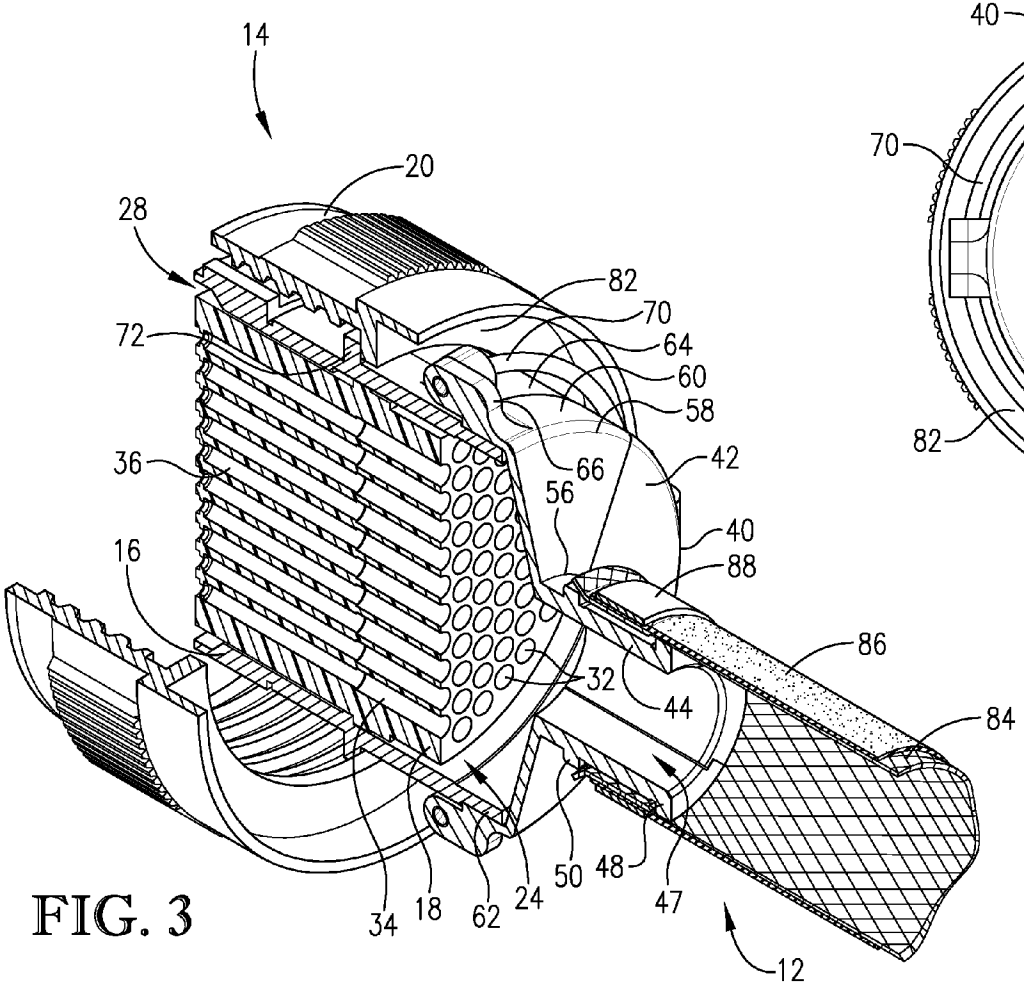
FIG. 3 is a cross-sectional view of an electrical connector assembly in accordance with one embodiment of the present invention.

Housing 16 is generally cylindrical in shape, but it is within the scope of the present invention for housing 16 to be substantially any tubular configuration, including square or rectangular. Housing 16 comprises a first port 24 that is configured to receive one or more wires 26 carried by cable 12 and a second port 28 that is configured to mate with, for example, a complemental port 30 of connector 22. As can be seen in the Figures, connector insert 18 is a receptacle-type, or "female," insert comprising a plurality of receptacles 32 disposed therein. Note, however, it is within the scope of the present invention for insert 18 to comprise a plug-type or "male" insert as is known in the art and shown, for example, in companion connector 22. As best seen in FIG. 3, receptacles 32 comprise a wire-receiving portion 34 located proximate the first port 24, and a plug-receiving portion 36 located proximate the second port 28. In certain embodiments, wire-receiving portion 34 is sized to receive both wire 26 and its insulating covering 38, whereas plug-receiving portion 36 generally is sized to accommodate only wire 26. As illustrated, connector insert 18 comprises 100 receptacles. However, it is within the scope of the invention for insert 18 to comprise any number of receptacles 32 in any configuration or pattern.

Figure 6:
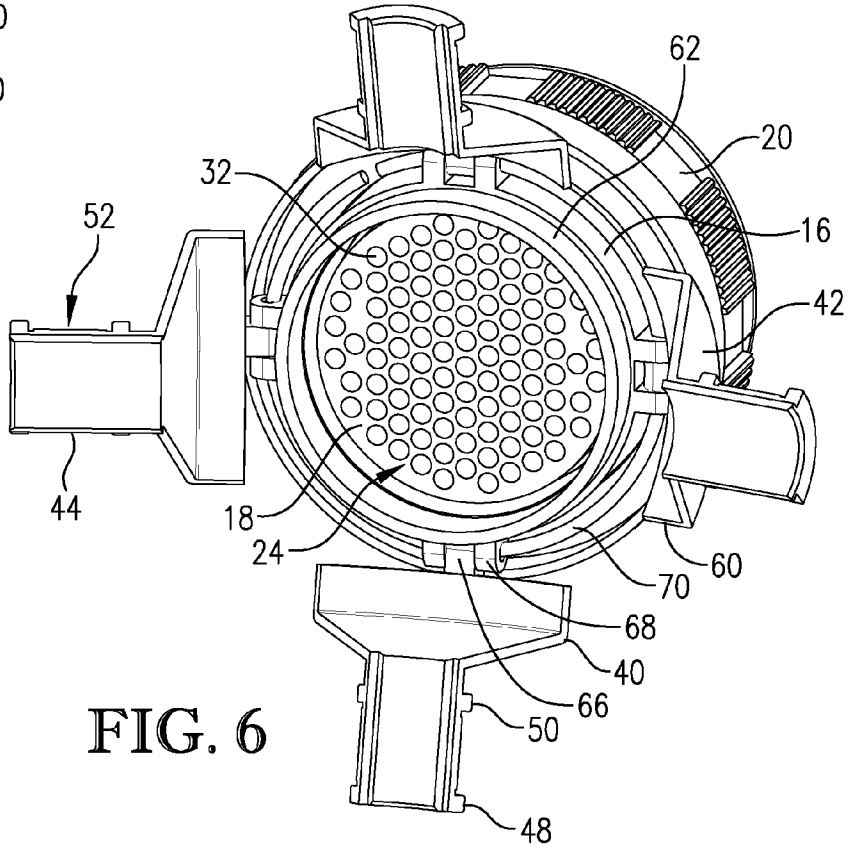
FIG. 6 is a perspective view of the electrical connector of FIG. 4 with the connector petals shown in the open configuration exposing the connector insert.
Figure 5:
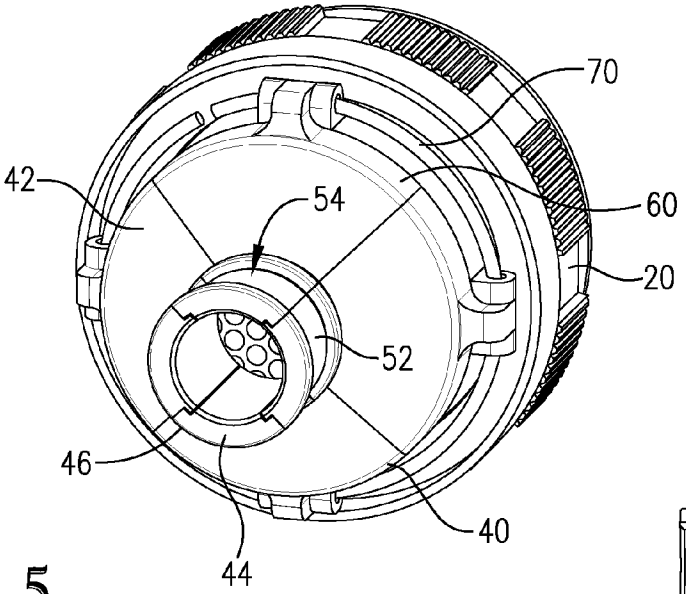
FIG. 5 is a perspective view of the electrical connector of FIG. 4 with the connector petals in the closed, port-blocking configuration.

A plurality of hinged petals 40 are secured to housing 16 adjacent to first port 24. In certain embodiments, connector 14 comprises at least three petals 40, and more preferably, four petals 40. Petals 40 are independently shiftable between a closed position as illustrated in FIG. 5, and an open position as illustrated in FIG. 6. Each of petals 40 comprises a substantially planar section 42 configured to cover at least a portion of first port 24 when in the closed position, and a nipple segment 44 extending transversely from planar section 42. When shifted to the open position, petals 40 swing outwardly thereby exposing and providing unfettered access to connector insert 18.

Planar section 42 comprises an inboard margin 56 and an outboard margin 58. Nipple segments 44 extend transversely from inboard margin 56 and in a direction away from first port 24, when petals 40 are oriented in the closed position. Nipple segments 44 cooperate to define a cable sheath termination nipple 46 when petals 40 are oriented in the closed position. Nipple 46 presents a central through opening 47 that communicates with first port 24. In certain embodiments, opening 47 has a diameter that is less than the diameter of connector insert 18. In particular embodiments, opening 47 has a diameter that is less than 75%, less than 65%, or less than 50% of the diameter of connector insert 18. Each of nipple segments 44 comprises an outboard rib 48 positioned proximal to the outboard end margin of the nipple segment and an inboard rib 50, with ribs 48, 50 defining a channel portion 52 therebetween. When petals 40 are in the closed position, channel portions 52 cooperating to define a continuous band-receiving channel 54 that circumscribes nipple 46.

Each of petals 40 further comprise a sidewall segment 60 extending transversely from outboard margin 58 and in a direction toward first port 24 when the petals or oriented in the closed position. In certain embodiments, connector housing 16 includes an offset shoulder 62 located proximate first port 24 that has a slightly reduced outer diameter as compared with other portions of housing 16. The amount of offset for shoulder 62 is approximately equal to the thickness of sidewall segment 60 so that when petals 40 are in the closed position, sidewall segment 60 lies substantially flush with an adjacent outer surface 64 of connector housing 16.

As shown in the Figures, petals 40 each comprise a hinge tab 66 located on sidewall segment 60. Tab 66 is configured to be received in a clevis 68, which is secured to outer surface 64 of housing 16. Tab 66 and clevis 68 include aligned apertures configured to receive a wire ring 70. Alternatively, a clevis pin inserted into each tab and clevis may be used instead of ring 70. However, it is noted that the illustrated hinge structure is exemplary and that other types and configurations of hinges may be employed.

Petals 40, as depicted in the Figures, are isometric. However, it is within the scope of the present invention for petals 40 to have differing dimensions and configurations. Also, connector 14 is depicted as a "straight" connector in which the cable sheath termination nipple 46 is coaxial with connector housing 16. It is noted, though, that the connector may be configured as an "angled" connector wherein these features are offset at a relative angle of 45° or 90°, for example. In the case of such angled connectors, petals 40, and their respective sub-parts, would need to be of different dimensions and configurations.

Connector housing 16 also comprises an upstanding ridge 72 that circumscribes outer surface 64. Outer surface 64 further includes a plurality of raised tabs 74 proximate second port 28. As illustrated, tabs 74 are of different sizes and shapes, and are spaced non-uniformly relative to each other. Tabs 74 are configured to be received in slots 76 disposed about an inner surface 78 of connector 22. The placement of tabs 74 and slots 76 assist a user in mating connectors 14 and 22 by providing proper alignment therebetween. Once mated, nut 20 may be rotated so as to engage threads 80 of connector 22. An inwardly extending collar 82 of nut 20 engages ridge 72 as nut is threaded onto connector 22 so as to draw the two connectors together and ensure that a solid electrical connection is made and maintained.

Figure 4:
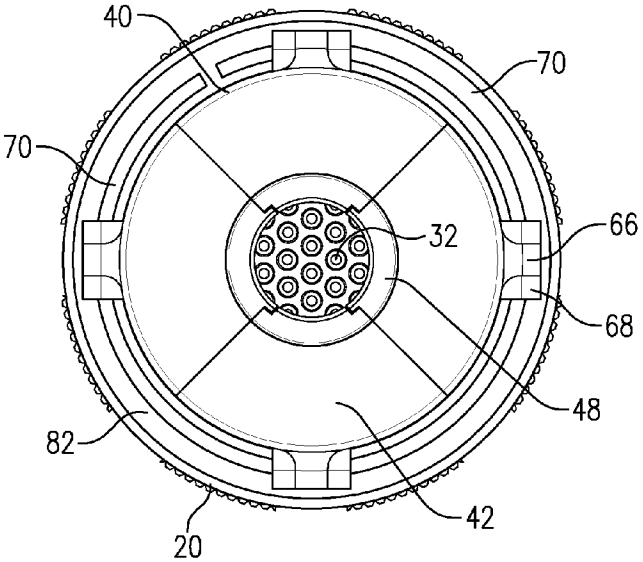
FIG. 4 is an elevation view of an electrical connector looking toward the connector's cable sheath termination nipple.
Figure 7:
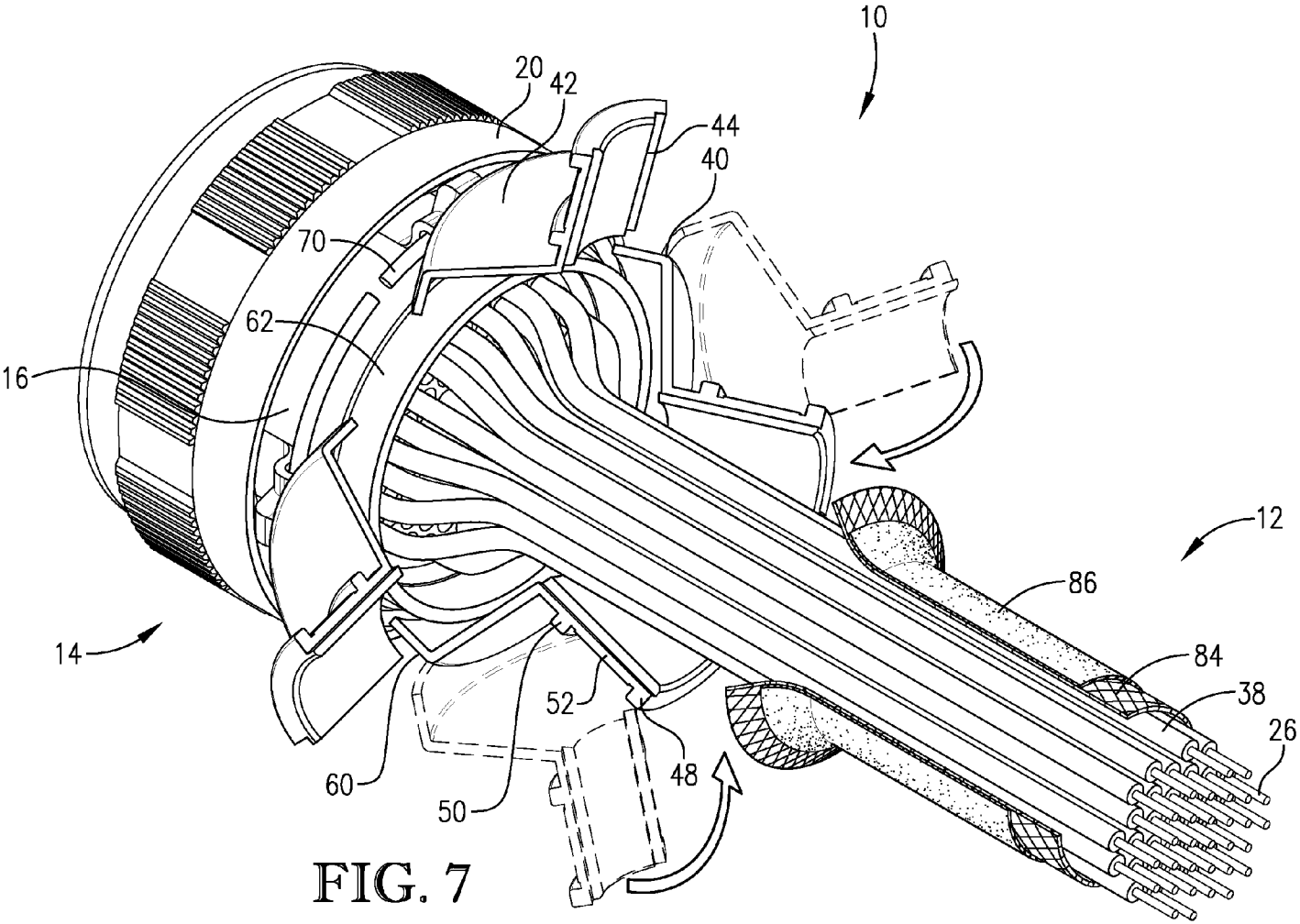
FIG. 7 is a perspective view of an electrical connector having a plurality of wires coupled therewith.

As previously noted, petals 40 are shiftable between closed and open positions. As seen in FIG. 4, when petals 40 are in the closed position, only a portion of the connector insert receptacles 32 are visible. The receptacles 32 located toward the outer periphery of connector insert 18 are covered and are not accessible for insertion of a wire 26. However, as illustrated in FIG. 7, shifting of petals 40 to the open position exposes or completely uncovers first port 24 thereby permitting access to all receptacles 32 through port 24. When petals 40 are in the open position, wires 26 carried by cable 12 may be inserted into respective receptacles 32, particularly those that would otherwise be inaccessible when petals 40 are in the closed position. Upon installation of wires 26, petals 40 can be returned to the closed position for securing cable sheath 84 to nipple 46 to complete electrical cable assembly 10.

As illustrated in FIGS. 1, 2, and 7, cable 12 comprises 31 individual wires 26. Note, it is within the scope of the present invention for cable 12 to include more or fewer wires as the particular application requires. However, in certain embodiments, the electrical cable 12 comprises fewer wires than connector insert 18 is capable of accommodating. In particular embodiments, cable 12 comprises a number of wires that is less than 75%, less than 60%, or less than 40% of the number of receptacles 32 of insert 18.

In certain embodiments, sheath 84 comprises a braided material that is capable of shielding the underlying wires from EMI. In particular embodiments, the braided material comprises a metal such as copper, iron, or stainless steel, and may be plated with a second metal such as tin or nickel. In still other embodiments, the braided shielding material may be a composite or thermoplastic material.

Given the difference in diameter between insert 18 and nipple 46, following insertion of wires 26 into respective receptacles 32, wires located toward the outer periphery of insert 18 may need to be bent or tapered toward the center of first port 24 so that petals 40 may be shifted to the closed position and the wires 26 directed through opening 47 of nipple 46. At that point, a portion of sheath 84 is slipped over nipple 46 and up to or, more preferably, just past inboard rib 50. Because nipple 46 may be sized according to the cable dimensions as opposed to having its size based upon that of the connector insert, over-stretching of sheath 84 and the formation of windows therein leading to undesirable EMI is avoided. Optionally, a rubber boot 86, made from a heat shrink material, can also be fitted over sheath 84 to provide added protection to the connection between cable 12 and connector 14. Once sheath 84 and boot 86 are in place in covering relationship to nipple 46, a band 88, such as a metallic spring band, may be placed there over and on top of channel 54 to securely anchor sheath 84 to connector 14. In addition, band 88 assists with maintaining petals 40 in the closed position. The necked-down configuration that petals 40 impart also provides additional securement of wires 26 within housing 16. Planar sections 42 offer resistance to removal of wires 26 from receptacles 32 as such would require deflection of wires 26 toward the center of first port 24.

Accordingly, connector 14 permits creation of electrical cable assemblies 10 using cables 12 having significantly fewer wires than connector insert 18 can accommodate without the use of a backshell adapter. Connector 14, through the use of hinged petals 40, provides the necessary access to the connector insert for installation of wires 26 while avoiding problems attendant with having to mount a small diameter cable sheath over a much larger cable sheath termination nipple. Thus, connector 14 permits direct termination of cables that in certain applications would otherwise require the use a backshell adapter.

The above described embodiments are exemplary of the principles of the present invention and are provided by way of illustration. Nothing therein should be taken as a limitation upon the overall scope of the invention.

I claim:

1. An electrical connector comprising:

a connector housing having a first port and a second port;

a connector insert located within said housing and comprising a plurality of wire-terminating receptacles;

a plurality of hinged petals secured to said housing adjacent said first port and shiftable between a closed position at least partially covering said first port and at least some of said wire-terminating receptacles and an open position fully exposing said connector insert and all of said wire-terminating receptacles, said petals when in said closed position cooperating to define a cable sheath termination nipple, said cable sheath termination nipple having a central through opening with a diameter that is less than the diameter of said connector insert.

2. The electrical connector according to claim 1, wherein each of said plurality of hinged petals comprises a substantially planar section configured to cover at least a portion of said first port when in said closed position and a nipple segment extending transversely from said planar section.

3. The electrical connector according to claim 2, wherein each of said nipple segments comprises two upstanding ribs defining a channel portion therebetween, when said petals are in said closed position, said ribs on each nipple segment cooperating to define a pair of circumscribing ridges that extend around the outer surface of said cable sheath termination nipple, and said channel portions cooperating to define a band-receiving channel that extends around the outer surface of said cable sheath termination nipple.

4. The electrical connector according to claim 2, wherein said planar section comprises an inboard margin and an outboard margin, said nipple segment extending transversely from said inboard margin and in a direction away from said first port.

5. The electrical connector according to claim 4, wherein each of said plurality of hinged petals comprises a sidewall segment extending transversely from said outboard margin and in a direction toward said first port.

6. The electrical connector according to claim 5, wherein said sidewall segment and said connector housing are configured so that when said petals are in said closed position, said sidewall segment lies substantially flush with an adjacent outer surface of said connector housing.

7. The electrical connector according to claim 1, wherein said electrical connector comprises at least three hinged petals.

8. The electrical connector according to claim 1, wherein each of said plurality of hinged petals are independently shiftable between said closed and open positions.

9. The electrical connector according to claim 1, wherein said cable sheath termination nipple central through opening has a diameter that is less than 75% of diameter of said connector insert.

10. An electrical connector comprising:

a connector housing having a first port and a second port;

a connector insert located within said housing and configured to receive one or more wires; and a plurality of hinged petals secured to said housing adjacent said first port and shiftable between a closed position at least partially covering said first port and an open position exposing said first port;

each of said hinged petals comprising a section configured to cover at least a portion of said first port when in said closed position and a nipple segment extending transversely from said section, said nipple segments cooperating to define a cable sheath termination nipple, said nipple segments including complementary shoulder structure such that upon shifting of said petals to the closed position the shoulder structure of one nipple segment engages and overlaps the shoulder structure of at least one other adjacent nipple segment, each of said nipple segments comprising two upstanding ribs defining a channel portion therebetween, when said petals are in said closed position, said ribs on each nipple segment cooperating to define a pair of circumscribing ridges that extend around the outer surface of said cable sheath termination nipple, and said channel portions cooperating to define a band-receiving channel that extends around the outer surface of said cable sheath termination nipple.

11. The electrical connector according to claim 10, wherein said section comprises an inboard margin and an outboard margin, said nipple segment extending transversely from said inboard margin and in a direction away from said first port.

12. The electrical connector according to claim 11, wherein each of said plurality of hinged petals comprises a sidewall segment extending transversely from said outboard margin and in a direction toward said first port.

13. The electrical connector according to claim 12, wherein said sidewall segment and said connector housing are configured so that when said petals are in said closed position, said sidewall segment lies substantially flush with an adjacent outer surface of said connector housing.

14. The electrical connector according to claim 12, wherein each of said plurality of hinged petals comprises a hinge tab located on said sidewall segment and configured to be received in a clevis located on said connector housing.

15. The electrical connector according to claim 10, wherein said electrical connector comprises at least three hinged petals, each of which are independently shiftable between said closed and open positions.

16. An electrical cable assembly comprising:

an electrical cable carrying one or more wires; and an electrical connector according to claim 1 secured to an end of said electrical cable.

17. The electrical cable assembly according to claim 16, wherein said electrical cable includes an outer sheath comprising a braided electromagnetic interference (EMI) shielding material.

18. The electrical cable assembly according to claim 17, wherein a portion of said outer sheath extends over at least a portion of the outer surface of said cable sheath termination nipple and is secured thereto by a spring band.

19. The electrical cable assembly according to claim 16, wherein said electrical cable carries fewer wires than said connector insert is configured to receive.

20. An electrical cable assembly comprising:

an electrical cable carrying one or more wires; and an electrical connector according to claim 10 secured to an end of said electrical cable.

21. The electrical cable assembly according to claim 20, wherein said electrical cable includes an outer sheath comprising a braided electromagnetic interference (EMI) shielding material.

22. An electrical cable assembly comprising:

an electrical cable carrying one or more wires; and an electrical connector comprising:

a connector housing having a first port and a second port;

a connector insert located within said housing and configured to receive one or more wires; and a plurality of hinged petals secured to said housing adjacent said first port and shiftable between a closed position at least partially covering said first port and an open position exposing said first port;

each of said hinged petals comprising a section configured to cover at least a portion of said first port when in said closed position and a nipple segment extending transversely from said section, said nipple segments cooperating to define a cable sheath termination nipple, said nipple segments including complementary shoulder structure such that upon shifting of said petals to the closed position the shoulder structure of one nipple segment engages and overlaps the shoulder structure of at least one other adjacent nipple segment, wherein said electrical cable includes an outer sheath comprising a braided electromagnetic interference (EMI) shielding material, wherein a portion of said outer sheath extends over at least a portion of the outer surface of said cable sheath termination nipple and is secured thereto by a spring band.

23. The electrical cable assembly according to claim 20, wherein said electrical cable carries fewer wires than said connector insert is configured to receive.

24. An electrical cable assembly comprising:

an electrical cable carrying one or more wires; and an electrical connector secured to an end of said electrical cable, said electrical connector comprising:

a connector housing having a first port through which said one or more wires are inserted and a second port;

a connector insert located within said housing and configured to receive said one or more wires;

a plurality of hinged petals secured to said housing adjacent said first port and shiftable between a closed position at least partially covering said first port and an open position exposing said first port, said petals when in said closed position cooperating to define a cable sheath termination nipple, said cable sheath termination nipple having a diameter that is less than the diameter of said connector insert, said hinged petals being fastened together in said closed position about said wires by a spring band that circumferentially extends around said cable sheath termination nipple.

* * * * *